US009468966B2

(12) United States Patent
Wasson

(10) Patent No.: US 9,468,966 B2
(45) Date of Patent: Oct. 18, 2016

(54) SYSTEM AND METHOD FOR RADICALLY EXPANDING HOLLOW CYLINDRICAL OBJECTS

(71) Applicant: Russell D. Wasson, Bourbon, MO (US)

(72) Inventor: Russell D. Wasson, Bourbon, MO (US)

(73) Assignee: HydroPro, Inc., Bourbon, MO (US)

( * ) Notice: Subject to any disclaimer, the term of this patent is extended or adjusted under 35 U.S.C. 154(b) by 214 days.

(21) Appl. No.: 13/986,870

(22) Filed: Jun. 13, 2013

(65) Prior Publication Data

US 2013/0340254 A1 Dec. 26, 2013

Related U.S. Application Data

(63) Continuation-in-part of application No. 13/134,189, filed on Jun. 1, 2011.

(60) Provisional application No. 61/690,296, filed on Jun. 25, 2012, provisional application No. 61/396,978, filed on Jun. 4, 2010.

(51) Int. Cl.
*B21D 39/20* (2006.01)
*B21D 39/06* (2006.01)

(52) U.S. Cl.
CPC ..... *B21D 39/203* (2013.01); *B21D 39/06* (2013.01); *B21D 39/20* (2013.01); *Y10T 29/49375* (2015.01); *Y10T 29/53122* (2015.01)

(58) Field of Classification Search
CPC .. B21D 41/02; B21D 41/026; B21D 41/028; B21D 39/206; B21D 53/02; B21D 53/08; B21D 39/06; B21D 39/20; B21D 39/203; B23P 15/26; Y10T 29/49364
See application file for complete search history.

(56) References Cited

U.S. PATENT DOCUMENTS 4,387,845 A * 6/1983 Mefferd ..... 228/222
4,414,739 A 11/1983 Kelly
4,502,308 A 3/1985 Kelly
4,530,231 A * 7/1985 Main ..... 72/393
5,062,199 A * 11/1991 Kelly ..... B21D 39/06 29/402.09
5,901,594 A 5/1999 Wasson et al.

OTHER PUBLICATIONS

HyrdoPro Inc., WeldLock Systems, May 19, 2011, https://web.archive.org/web/20110519113639/http://www.hpro.com/products/weldlock.php.*

* cited by examiner

*Primary Examiner* — Jason L Vaughan
*Assistant Examiner* — Amanda Meneghini
(74) *Attorney, Agent, or Firm* — Paul M Denk

(57) ABSTRACT

A system and method for radially expanding hollow cylindrical objects, through the use of a tube expansion tooling, affixing a mandrel in place, the tooling rendered operative through the generation of hydraulic pressure, to provide the axial force necessary for pulling of the mandrel into the tool, and the mandrel having concentrically applied thereon various spacers, cams, and curved segments, which when the drawbar of the mandrel is pulled, manual forces are generated through the cams and segments into an expansion capacity to force the expansion of any tube in which the mandrel locates, to be expanded into a tight binding fit within a tube sheet or any other bore hole formed in equipment.

2 Claims, 4 Drawing Sheets

SYSTEM AND METHOD FOR RADICALLY EXPANDING HOLLOW CYLINDRICAL OBJECTS

CROSS REFERENCE TO RELATED APPLICATION

This non-provisional patent application claims priority to the provisional patent application having Ser. No. 61/690,296, filed on Jun. 25, 2012; this application also claims priority as a continuation-in-part to the non-provisional patent application having Ser. No. 13/134,189, and filed on Jun. 1, 2011, now Publication No. US 2011-0297264 A1, which claims priority to the provisional patent application having Ser. No. 61/396,978, filed on Jun. 4, 2010.

FIELD OF THE INVENTION

This invention generally relates to a system and method for hydraulically generating a force for mechanically expanding hollow cylindrical objects, and more specifically pertains to the expansion of tubes of the type as found in boilers, condensers, and other type of heat exchangers, and in related devices, for affixing the tubes to the holes bored through solid objects such as a pressure vessel tube sheet, or any other type of tube holding means, prior to the welding of the tubes in place, or hydraulically expanding them in place, or mechanically expanding them in place.

BACKGROUND OF THE INVENTION

As is known in the art, when welding tubes to tube sheets, the tubes are usually loose and slightly off center in the previously drilled holes of the tube sheet. This creates problems during the welding process, which can lead to defective welds. Repairing the defective welds adds delays and costs to the project. Tubes in tube sheets that need to be expanded either mechanically (with mechanical rollers) or hydraulically (with hydraulic expansion equipment) tend to be loose and may move out of position when inserting the expansion tooling, or during the actual expansion process. If the tube moves out of position during the process, it is difficult to reposition it and may require the tube to be removed, and a new tube installed in its place. This can cause delays and add to the cost of the project, and furthermore, can generally lead to inaccuracies in the structure of the tube sheet mounted tubes, or in any other type of structure in which the tubes have been located.

Other methods of securing tubes prior to their welding either leaves them off center, such as through pinning, or closes the gap between the tube and the tube sheet completely, such as through mechanical rolling, which traps the weld gases during the subsequent welding process, and can lead towards defective welds, and generally porosity in the weld joints. When using mechanical rollers or other tube setting devices that require the use of a lubricate to reduce friction when operating, the lubricate residue left behind must be removed prior to welding.

Furthermore, through the use of the current type of cams and segment assemblies that employ and work with polyurethane expanders, such can sometimes create a complete seal between the tube and the tube sheet, but it can trap the weld gases during the welding process. This can also provide deficiencies.

In the patent to Russell D. Wasson and David A. Vossbrinck, U.S. Pat. No. 5,901,594, issued on May 11, 1999, for High Pressure Expansion Mandrel with Cams Engaging Oppositely Directed Ends of an Expandable Segmented Ring, there is disclosed a high pressure mandrel for joining a metal tube to a wall of a metal sheet surrounding an annual bore of the metal sheet. This type of device utilizes hydraulic pressure directly within the mandrel, to provide for expansion, and exert hydraulic pressure upon the metal tube to be emplaced, in trying to set it into a permanent installation.

Other prior art patents include the patent to Kelly, U.S. Pat. No. 4,502,308, explaining a Swaging Apparatus Having Elastically Deformable Members with Segmented Supports. Therein is disclosed a swaging mandrel to be inserted into a tubular structure that is radially expandable. The shown device therein utilizes hydraulic pressure for achieving the swaging forces.

Another patent to Kelly, U.S. Pat. No. 4,414,739 shows an Apparatus for Hydraulically Forming Joints between Tubes and Tube Sheets. Once again, this discloses a mandrel, where pressurized hydraulic fluid is generated therein, that allows hydraulic fluid under pressure to enter an annular volume between the body and the interior wall of the tube, wherein it may expand the tube to provide for its seating within the tube sheet.

SUMMARY OF THE INVENTION

This particular invention contemplates the construction of a system and tooling that radially expands hollow metal cylindrical objects, such as but not limited to tubes and pipes, and locks them in place in holes bored through solid objects, such as, but not limited to, pressure vessel tube sheets prior to their welding of the tubes to the tube sheets or prior to the tube-tube sheet joint expansion.

The present invention solves previous problems by centering the tubes in the tube sheet holes, as it secures it from moving once precisely located. This invention centers the tube, locks it in place to prevent movement and leaves escape paths for the weld gases generated during the welding process without the use of lubricants that can contaminate the weld joint.

The present invention, unlike the prior art, works without the use of any polyurethane expanders, by improving the mechanical advantage of the cams and segment assembly which allows them to provide sufficient outward expansion forces in targeted areas to expand and center the tube while securing it in the tube sheet. The outer surface of the segment pieces in the segment assembly has been further enhanced to direct the radial force into a more concentrated area. By directing the outward force only to targeted areas, it leaves a gap between the tubes outer surface and the inner surface of the tube sheet hole in the non-targeted areas.

Generally, this invention contemplates the usage of a hydraulic power supply, that includes a hydraulic pump, a reservoir, and associated controls and indicators, which control and monitor the hydraulic pressure and the sequence of its operations, during setting of tubes within a tube sheet, or the like. The essence of this invention is to utilize hydraulic pressure on the drawbar segment of the mandrel assembly, with the drawbar being located within the hydraulic pull cylinder of the equipment, so as to pull the drawbar during its usage and application. In doing so, the mandrel further includes a series of spacers, cams, segment assembly, retaining washers, and retaining nuts, so that when the hydraulic pull cylinder pulls the mandrel assembly, through hydraulics, mechanical forces generated upon these components mounted upon the mandrel, and provide for their expansion, or the expansion of various segments of the pressure means, that forces the segment assembly outwardly, against the interior of the tube in which the mandrel locates, and pressures and expands the tube against the inner surface of the tube sheet, to affix the tube in place therein. But, in doing so, since the mechanical pressure segmented assembly is just that, made up of a series of independent segments, that are expanded, the space between the expanded mechanical segments leaves miniscule gaps between the surface of the expanded tube, and the surface of the inner diameter of the tube sheet in which the hole is located, and these slight gaps leave escape paths for the weld gases generated during the subsequent welding process, which allows the weld gases to freely escape from the region where welding takes place.

It is, therefore, the principal object of this invention to provide a combination hydraulic and mechanical system and method for initially locating tubes within a tube sheet, or other structure, and to provide for the precise locating of the tube centered within the predrilled or formed holes of the tube sheet, so that once expansion occurs, it will be done uniformly around the circumference of the outer surface of the tube, as it expands into and biases against the inner diameter of the tube sheet hole.

Still another object of this invention is the generation of escape paths between the emplaced tube, and the tube sheet, so that when welding occurs, the weld gases can escape during the welding process, and thereby eliminate any deficiencies that may otherwise be generated in the connection, because of captured gases.

Another object of this invention is to use a combination of high pressure hydraulics, for physically moving a mandrel, while using mechanical generated forces for expanding a precisely located tube into contact with the tube sheet or other structure in which it is being mounted.

Another object of the present invention is to utilize high pressure hydraulic generated force for a mandrel to provide for its push or pull, in order to generate mechanical pressures at a caming region upon the same mandrel to precisely force a tube into contract with a tube sheet during its location and installation. This high pressure medium of the hydraulic forces that push or pull the mandrel may be generated through developed pressures between about 100 psi and 15,000 psi during usage of the system and tooling.

Another object of the present invention is to provide a high pressure fluid supply system to provide fluid under pressure to a mandrel, to provide for its push or pull, for generating mechanical forces along a region of the mandrel to furnish expansion of tubes for setting them within a tube sheet.

Another feature of the present invention is to provide a high pressure fluid supply system that is portable and able to operate under most conditions, to generate hydraulic forces for acting upon a mandrel that creates mechanical radial forces for expanding a tube during its installation.

Still another object of this invention is to provide a mandrel segment assembly, made up of arc shaped segments that may expand radially outwardly to generate significant mechanical forces upon the interior of a tube to expand it, and provide for its setting within a tube sheet or other structure.

These and other objects may become more apparent to those skilled in the art upon review of the summary of the invention as provided herein, and upon undertaking a study of the description of its preferred embodiments, in view of the drawings.

DESCRIPTION OF THE PREFERRED EMBODIMENT

The system and tooling for this particular application provides for their radially expansion of hollow metal cylindrical objects, specifically relating to tubes and pipes, that lock them in place, in holes bored through solid objects, such as a tube sheet, but more generally, this invention can be used for expanding any type of cylindrical object, through the use of the style of handheld mandrel assembly of this invention, for providing a binding connection between any cylindrical object, within the bored holes of any supporting solid object, during their assembly.

Figure 1:
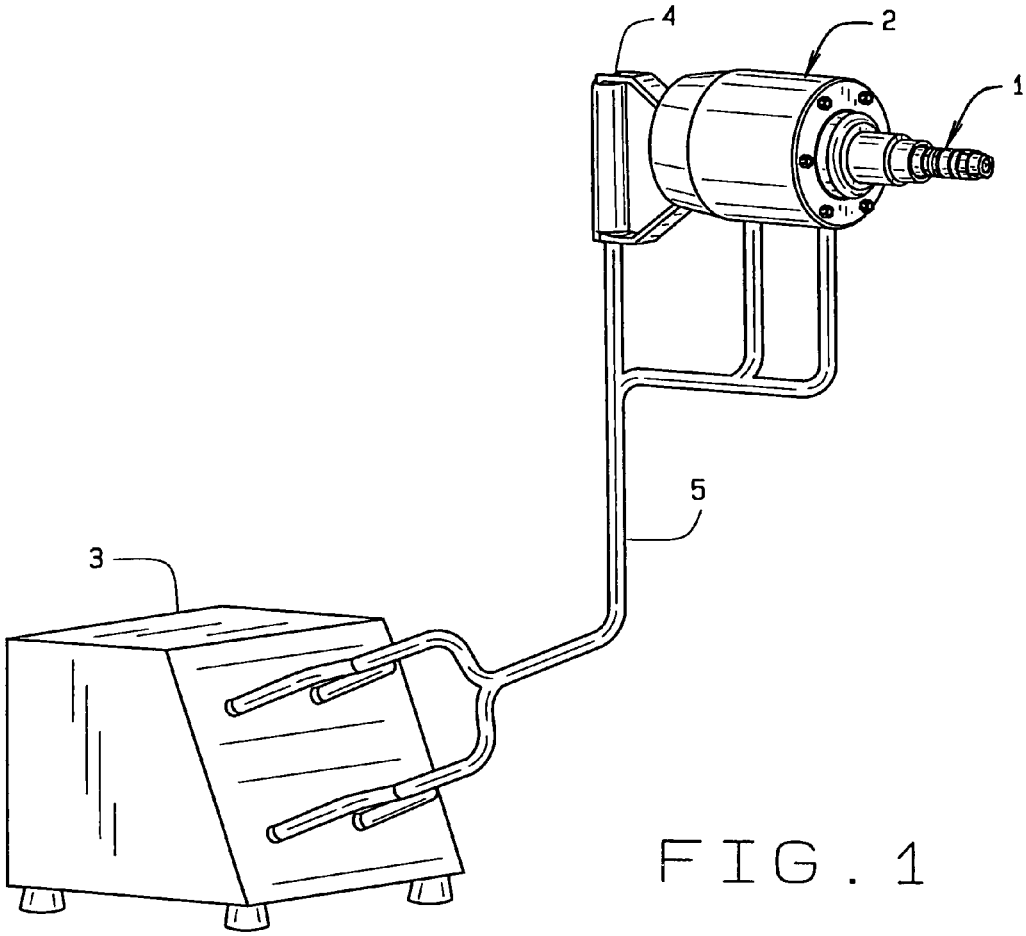
FIG. 1 shows the mandrel assembly of this invention mounted within its hydraulic pull cylinder, incorporating a control handle which allows for its manual usage, and all connected by means of electrical or pneumatic and hydraulic lines to generate the pressures needed for hydraulically shifting the mandrel during usage of this system.

The equipment used in the tube expansion system and method of this invention is generally disclosed in FIG. 1. The overall tooling includes a mandrel assembly 1, generally sized for the specific tube internal diameter (ID) that is to be expanded. The hydraulic pull cylinder or tool 2 is used to provide for the axial compression forces exerted upon the mandrel assembly, and this tool is supplied with hydraulic power, under significant pressure, from the hydraulic supply 3, as can be noted. The object of the hydraulic power supply, for supplying high pressure to the tool 2, is to provide and to actuate the pull cylinder and its associated controls for the operator to control the actuation sequence and usage of the tool affording a radial expansion of the mandrel, for expanding any tube in which it is located, during usage.

The hydraulic power supply 3 includes its hydraulic pump, the reservoir, and the associated controls and indicators that may be set, control, and monitor the hydraulic pressure generated by the supply, and its sequence of usage.

The hydraulic pull cylinder tool 2 includes its handle 4, and incorporates operator controls for regulating the pull cylinder, and the umbilical assembly 5, that connects to the hydraulic power supply, and conveys pressurized fluids to the tool, during its usage.

Figure 1A:
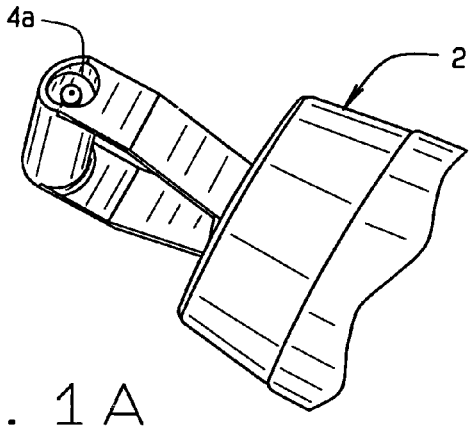
FIG. 1A is an oblique view of just the handle system showing the finger control for use in controlling the operations of this tooling.

FIG. 1A discloses how the handle 4 for the tool includes a thumb control, as at 4*a*, which can be used for initiating the pull sequence of the mandrel, to achieve its expansion, when locating a tube into position within the bore hole in which it locates.

Figure 2:
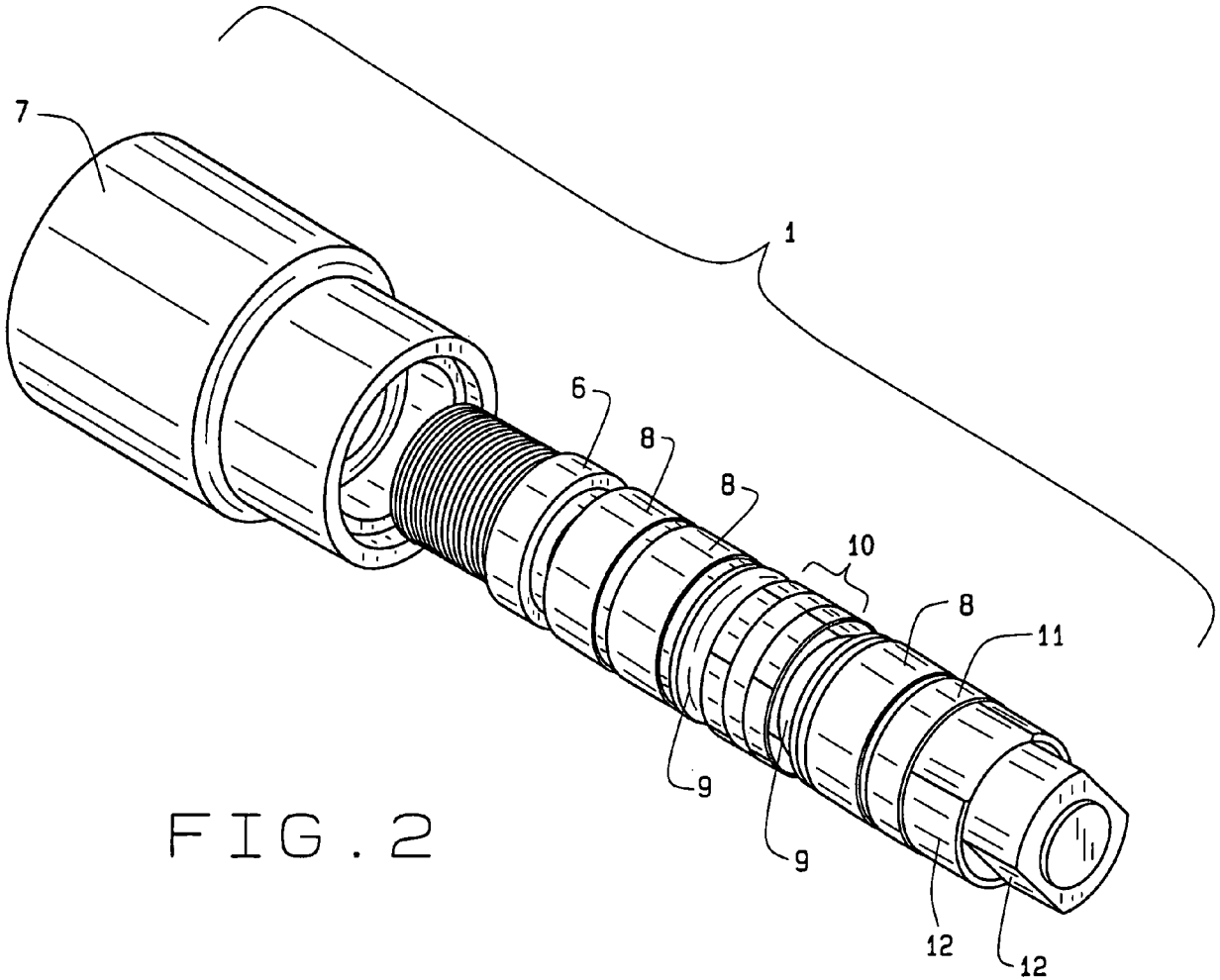
FIG. 2 is an isometric view of the mandrel assembly and the collar of the tooling for this invention.

The mandrel assembly 1, generally as noted in FIG. 2, is constructed of its drawbar 6, which may threadedly engage within the operating mechanisms of the pull cylinder 2, inserted through collar 7, as can be seen. There are a series of operating spacers 8, the segmented expansion assembly 10, the retaining washer 11, and the retaining nuts 12 that hold all of said components in place upon the mandrel assembly. The application and usage of these components upon the mandrel assembly will be better described from their functionality, when describing the operative use of this assembly in expanding a tube within a tube sheet, and the like.

Figure 3:
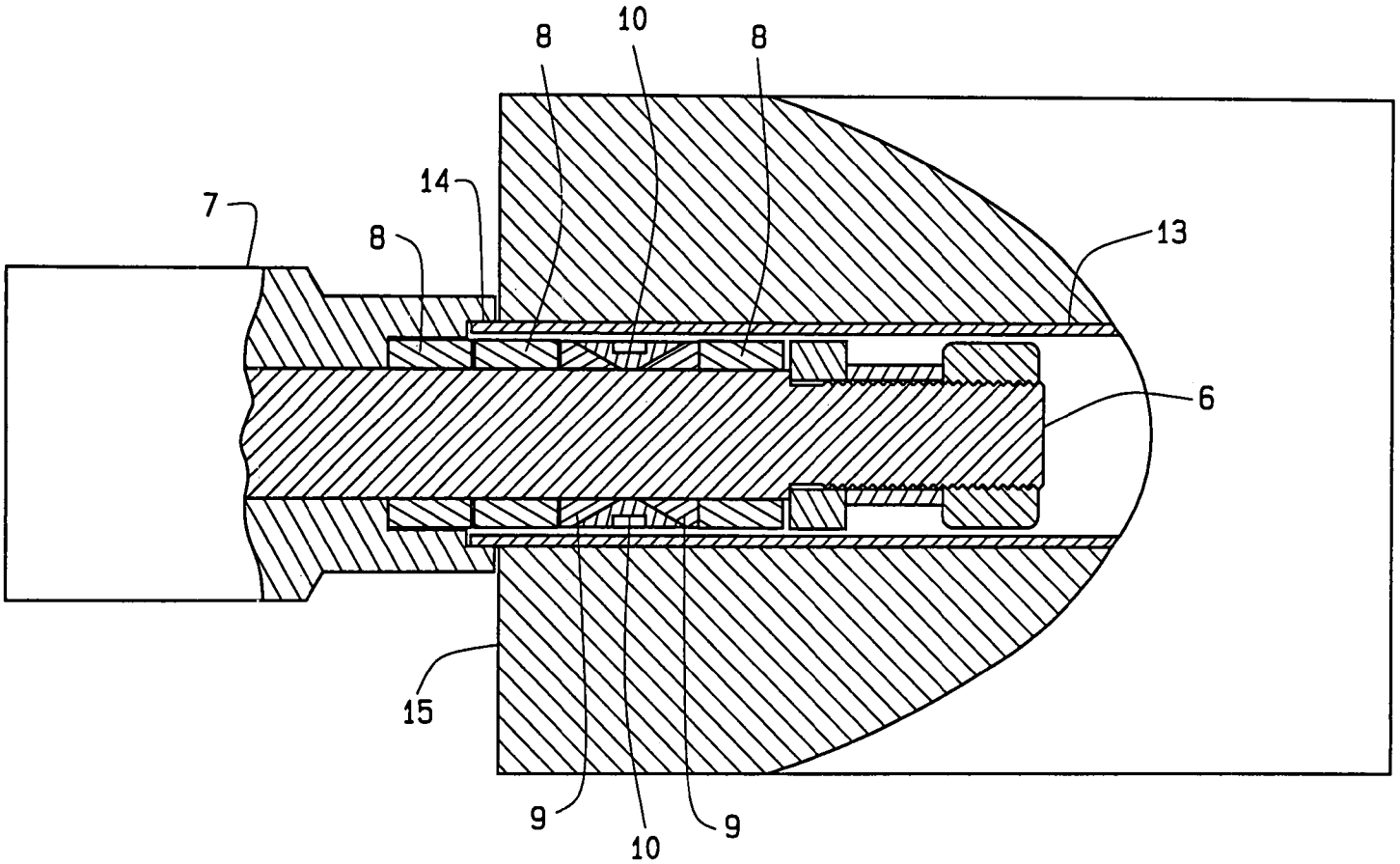
FIG. 3 is a sectional view of the mandrel assembly of FIG. 2, showing it located into position within a tube to be affixed to the tube sheet of a boiler, condenser, heat exchanger, or any related equipment.

In the usage of this invention, one initially determines the correct size for the tooling to be used by obtaining the ID of the tube 13 to be expanded. (See FIG. 3) FIG. 3 provides a sectional view of a tube located within a tube sheet, and with the mandrel assembly and its drawbar 6, containing all of its operative components located thereon, in preparation for an expansion and setting of the tube within the tube sheet, during its usage. Then, one determines if the tube end 14 should be positioned to be set flush, recessed, or protruding from the tube-sheet face 15, which is the setting shown in said FIG. 3. The configuration of the collar 7 face determines the setting of the resulting tube end 14 with respect to the tube sheet face 15 relationship. Then, the user selects the correct collar 7 that will provide the proper tube end position 14, required.

Then, the user assembles the mandrel 1 with the various parts as previously defined, and selected for the specific size of tube to be expanded.

The mandrel assembly 1 is then inserted through the collar, and then screwed into the pull cylinder 2 until it is firmly set. The various cams 9, and the segment expansion arc or curved segments 10, in addition to the spacers 8 on the drawbar, should all have about a ⅛" to ¼" of free axial direction of movement. The axial travel distance can be increased or decreased by changing of the width of the spacers 8 as installed on the drawbar 6.

Prior to beginning the functioning of the tube setting and expansion process, the position of the tube ends 14 should be carefully checked in relation to the tube sheet face 15, so that the proper setting has been made. The ideal positioning for the tube end 14 that will be set flush is slightly protruding prior to expanding. Because of the expansion characteristics, a slightly protruding tube will end up being set flush with the tube sheet face, after expansion has been achieved. For a tube 13 that will be set protruding, the ideal position for the tube end 14 is to protrude slightly past the desired finished position prior to its expansion. For a tube end 14 that will be fixed recessed, after expansion has occurred, the ideal positioning of the tube end will be flush with the tube sheet face 15 prior to performance of the expansion process.

One begins the expansion process by inserting the mandrel assembly 1 into the tube end 14. Then, one presses the pull cylinder 2 and the mandrel assembly 1 up against the face of the tube sheet 15 until the collar 7 is seated fully against the face of the tube sheet 15. The power supply 3 is then activated, by depressing the pneumatic switch/button 4*a* while maintaining enough forward pressure on the pull cylinder 2 to keep the collar 7 fully seated on the tube sheet face 15. The power supply 3 then provides high pressure fluid via the umbilical lines 5 that are attached to the pull cylinder 2, which actuates the cylinder to exert a pressure on the mandrel assembly 1. As that occurs, the drawbar 6 of the mandrel is pulled axially. This action pulls the drawbar 6 and the parts on the mandrel, such as the spacers 8, the cams 9, and the arch segment assembly 10 towards the pull cylinder 2, and its collar 7. As the drawbar 6 is pulled towards the pull cylinder 2, it compresses the parts on the shaft together. The resulting pulling axial force on the cams 9 and the arc segment assembly 10 engages the cams, and the arc segments of the assembly 10 are forced to expand radially, as can be seen.

Figure 4:
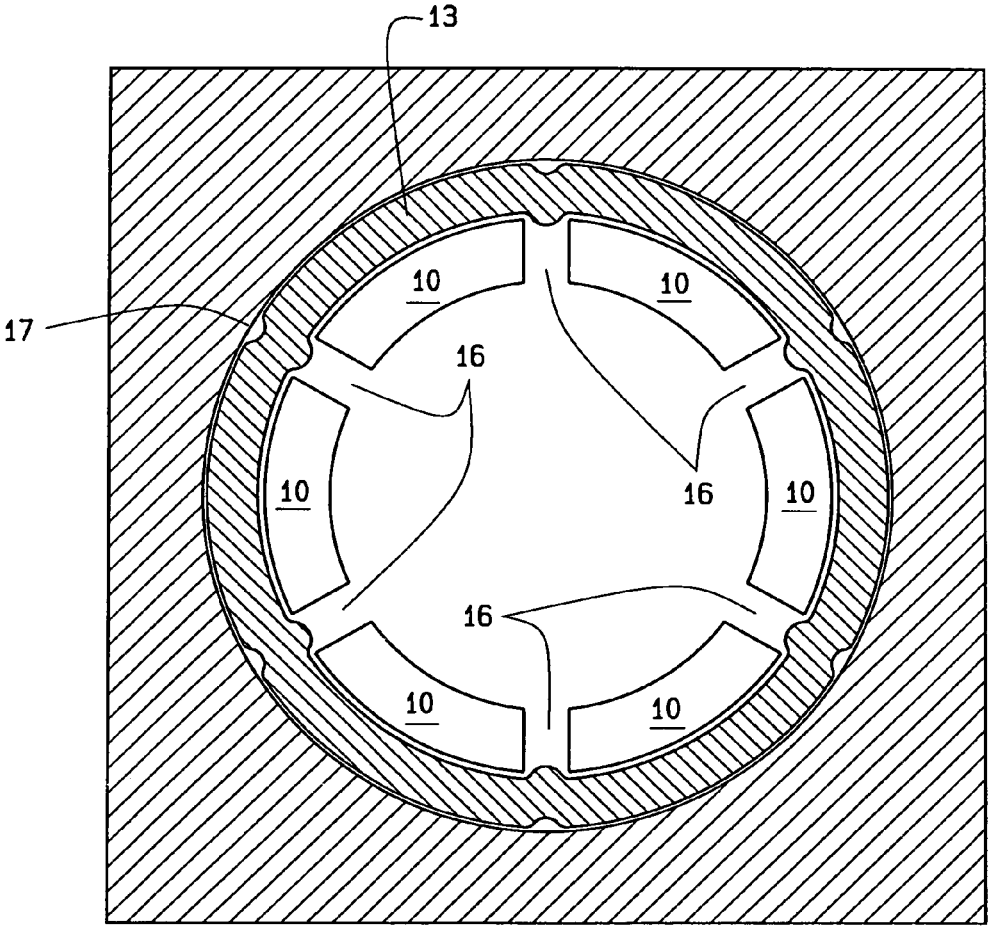
FIG. 4 is a transverse sectional view taking generally through the location of the segment 10 for the mandrel as shown in FIG. 2, showing the various arc or curved shaped segments that are expanded during usage of this system.

FIG. 4 of the drawings provides an end view of the sectioned arc segment assembly/tube in its expanded position. The hydraulic force in the tool causes a manual pull of the drawbar 6, and this causes the axial forces of the arc segments 10 to be transmitted as radial forces through the entire segment assembly 10. As the segment arcs expand, they close the gap between the segment assembly 10, and its outer surfaces, and the tube 13 inner surface, and as the two surfaces come into contact, the resulting forces centers the mandrel assembly 1 in perfect alignment within the tube hole. As the force increases, the resulting friction caused by the contact of the outer segment assembly 10 surface and the tube 13 inner surface this causes the mandrel assembly 1 to pull the tube 13 slightly towards the pull cylinder 2 until it comes into contact with the collar 7. With the collar 7 in contact with and indexing off of the tube sheet face 15, the tube end 14 stops at a precise distance from the tube sheet face 15, which is dictated by the specific choice of the collar 7 design as assembled into the setup. As the pull cylinder 2 continues to retract, the mandrel parts are further compressed, resulting in an increase in the radial forces being applied to the inner surface of the tube 13, to provide for its setting and affixing within the tube sheet. This is achieved through the cams 9 that compress against the arc segments of the assembly 10, as can be understood. As the segment assembly 10 expands outwardly, various spaces or gaps 16 naturally expand between the arc segment assembly 10 parts leaving areas void of contact between the segment assembly 10, and the outer surfaces of the tube 13 inner surface. These radial forces are directed through the arc segment assembly 10 parts and apply pressure directly to the tube 13 inner surface, only where the arc segments of the assembly 10 parts come into direct contact with the inner surface of the tube 13. When enough pressure is applied, this force will overcome the resistance of the tube material against expansion, causing the tube 13 to expand until the outer tubes surface adjacent to the segment assembly 10 parts comes into contact with the tube sheet hole inner surface 17. The tube 13 surfaces that are adjacent to the void area 16 between the segment assembly 10 parts will have small gaps between the tube outer surface and the tube sheet hole inner surface, as noted at 17. The final force applied at this point is dependent upon the output pressure of the power supply 3, and the pressure generated by its hydraulic fluid, upon the pull cylinder 2. The time that this pressure is applied, known as the dwell time, can be controlled by the operator and will be sustained as long as the operator continues to depress the pull cylinders pneumatic button/switch 4*a*. After achieving the desired pressure and dwell time, the operator releases the pneumatic button/switch 4*a*, and waits for a few seconds for the pull cylinder 2 piston to extend outwardly, and for the tooling to disengage from the tube in which it locates. The operator then removes the mandrel assembly 1 from the tube and inserts into the next tube end to be expanded, and repeats the overall process, for expansion of the next tube. The ideal expansion force and dwell time is just enough to prevent the tube from rotating in the tube sheet hole and to resist tube movement when 10 lbs to 15 lbs of actual force is applied after the tooling is removed from the tube hole.

As previously summarized, the provision of the slight gaps 17 between the expanded tube, and the inner surface of the hole in the tube sheet, provides that slight spacing that allows the gasses generated when the tubes are subsequently welded to the tube sheet, and provides for those gasses to escape, and be exhausted to ambient atmosphere, or into the interior of the equipment in which the tube sheet locates, whether it be a boiler, heat exchanger, or any other equipment in which tubes need to be precisely affixed.

Variations or modifications to the subject matter of this invention may occur to those skilled in the art upon review of the development as provided herein. Such variations, within the spirit of this invention, are intended to be encompassed within the scope of any claims to patent protection provided hereon. The description of the preferred embodiment, and the depiction of the invention as set forth in the drawings, is primarily set forth for illustrative purposes only.

I claim:

1. A combination hydraulic and mechanical system for use for expanding hollow cylindrical objects such as tubes within the holes of a tube sheet for a boiler, condenser, and heat exchanger, with each of the tubes having an interior surface and an exterior surface, the system comprising:

a portable hand held mandrel assembly, said mandrel assembly including a drawbar, and a collar, said drawbar engaging at one end within said collar;

said collar also providing for establishing the positioning of the tube ends relative to the tube sheet during setup of the mandrel assembly for usage;

a hydraulically operative pull tool, a handle with operative controls provided upon said pull tool, said mandrel assembly engaging within said pull tool;

a hydraulic supply provided for fluid communication with said pull tool, and supplies to said pull tool the fluid pressure to pull the drawbar of the mandrel assembly partially into said pull tool;

spacers, cams, and independent arc curved die segments concentrically provided adjacently upon said drawbar of the mandrel assembly, with each of the independent arc curved die segments having a pair of adjacent ends;

said hydraulically fluid pressure operates within the pull tool to hydraulically pull the mandrel assembly drawbar partially therein, while the drawbar and mandrel assembly mechanically force the curved die segments to expand a tube into contact with the hole of a tube sheet in which the tube locates;

there being a space provided between the ends of each adjacent independent arc curved die segments when the drawbar and mandrel assembly mechanically force the curved die segments to expand, wherein the expansion of the tube by the curved die segments against the interior surface of a hole of the tube sheet provides between the adjacent ends of each adjacent curved die segment an indented gap to be formed on the exterior surface of the tube between the expanded tube and the tube sheet hole to allow venting of generated welding gases when the tube is subsequently welded in place within its tube sheet;

said plurality of independent curved die segments are annularly provided upon the drawbar, said cams including a pair of cams, one of each cam provided adjacent to the curved die segments, and each of the curved die segments and cams having caming surfaces mating against each other, said spacers include a pair of spacers, one of each spacer provided adjacent to each of the cams;

a retaining nut securing the spacers, cams, and curved die segments onto the drawbar of the mandrel assembly, such that when the drawbar is partially pulled inot the pull tool, the curved die segments incline upon the cam surfaces into expansion for select expansion of the emplaced tube to be fixed within the tube sheet during its setting; and whereby the said mandrel assembly selectively expands a tube into fixed contact with a hole in the tube sheet in which the tube has been positioned for securement by the operations of the mandrel assembly.

2. The system of claim 1 wherein the retaining nut is a threaded nut that threadily engages onto the other end of the drawbar of the mandrel assembly.

* * * * *